US010767651B2

(12) United States Patent
Furuya et al.

(10) Patent No.: US 10,767,651 B2
(45) **Date of Patent: *Sep. 8, 2020**

(54) TWO-CYLINDER HERMETIC COMPRESSOR

(71) Applicant: Panasonic Intellectual Property Management Co., Ltd., Osaka-shi, Osaka (JP)

(72) Inventors: Shiho Furuya, Kyoto (JP); Hideyuki Horihata, Shiga (JP); Hiraku Shiizaki, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 316 days.

This patent is subject to a terminal disclaimer.

(21) Appl. No.: 15/427,879

(22) Filed: Feb. 8, 2017

(65) Prior Publication Data

US 2017/0248140 A1 Aug. 31, 2017

(30) Foreign Application Priority Data

Feb. 26, 2016 (JP) ..... 2016-035036

(51) Int. Cl.
*F04C 29/00* (2006.01)
*F04B 39/14* (2006.01)
(Continued)

(52) U.S. Cl.
CPC ..... *F04C 29/0057* (2013.01); *F04B 35/04* (2013.01); *F04B 39/0246* (2013.01);
(Continued)

(58) Field of Classification Search
CPC .. F04C 23/001; F04C 18/3564; F04C 23/008; F04C 29/0021; F04C 29/0057;
(Continued)

(56) References Cited

U.S. PATENT DOCUMENTS

2010/0147013 A1* 6/2010 Hirayama ..... F04C 18/356 62/401
2014/0250937 A1* 9/2014 Hirayama ..... F04C 23/008 62/296
2016/0018136 A1* 1/2016 Hirayama ..... F01C 21/02 62/401

FOREIGN PATENT DOCUMENTS

CN 102080658 A 6/2011
CN 103912501 A 7/2014
(Continued)

OTHER PUBLICATIONS

English Translation of Chinese Search Report dated Apr. 23, 2019 for the related Chinese Patent Application No. 201710090061.5, 2 pages.

*Primary Examiner* — Essama Omgba
*Assistant Examiner* — Stephen A Mick
(74) *Attorney, Agent, or Firm* — Hamre, Schumann, Mueller & Larson, P.C.

(57) ABSTRACT

In the two-cylinder hermetic compressor, a first compression mechanism unit includes a first cylinder and a first piston, and a second compression mechanism unit includes a second cylinder and a second piston. A main bearing is disposed on one surface of the first cylinder, and an intermediate plate is disposed on another surface of the first cylinder. The intermediate plate is disposed on one surface of the second cylinder, and an auxiliary bearing is disposed on another surface of the second cylinder. A shaft is constituted by a main shaft portion which has a rotor attached thereto and is supported by the main bearing, a first eccentric portion having a first piston attached thereto, a second eccentric portion having a second piston attached thereto, and an auxiliary shaft portion supported by the auxiliary bearing. The diameter of the auxiliary shaft portion is set larger than the diameter of the main shaft portion.

9 Claims, 4 Drawing Sheets

(51) Int. Cl.

| | |
|---|---|
| ***F04B 35/04*** | (2006.01) |
| ***F04B 39/02*** | (2006.01) |
| ***F04B 39/12*** | (2006.01) |
| ***F04C 18/34*** | (2006.01) |
| ***F04C 23/00*** | (2006.01) |

(52) U.S. Cl.
CPC ..... *F04B 39/121* (2013.01); *F04B 39/14* (2013.01); *F04C 18/34* (2013.01); *F04C 23/001* (2013.01); *F04C 23/008* (2013.01); *F04C 29/0085* (2013.01); *F04C 2210/26* (2013.01); *F04C 2240/50* (2013.01)

(58) Field of Classification Search
CPC .. F04C 27/008; F04C 29/0085; F04C 18/356; F04C 2240/54; F04C 2240/56; F04C 2240/601; F04C 2240/60; F04C 2240/30; F04C 2240/40; F04C 2240/50; F04C 2240/605; F04C 2240/603; F01C 21/02; F01C 21/108; Y10S 417/902
See application file for complete search history.

(56) References Cited

FOREIGN PATENT DOCUMENTS

| | | |
|---|---|---|
| JP | 5-099171 A | 4/1993 |
| JP | 2008-014150 | 1/2008 |
| WO | 2009/031626 A1 | 3/2009 |

* cited by examiner

| | Main shaft portion | Eccentric portion | | Auxiliary shaft portion |
|---|---|---|---|---|
| | | Main shaft portion side | Auxiliary shaft portion side | |
| Comparative example | ϕ24.0mm | ϕ36.3mm | ϕ36.3mm | ϕ24.0mm |
| Example 1 | ↑ | ↑ | ϕ37.3mm | ϕ25.0mm |
| Example 2 | ↑ | ↑ | ϕ38.3mm | ϕ26.0mm |
| Example 3 | ↑ | ↑ | ϕ39.3mm | ϕ27.0mm |
| Example 4 | ↑ | ↑ | ϕ40.3mm | ϕ28.0mm |

TWO-CYLINDER HERMETIC COMPRESSOR

BACKGROUND

1. Technical Field

The present disclosure relates to a two-cylinder hermetic compressor used for an outdoor unit of an air conditioner and a freezer.

2. Description of the Related Art

Generally, a hermetic compressor used for an outdoor unit of an air conditioner and a freezer includes an electric motor unit and a compressor mechanism unit in a sealed container. The electric motor unit and the compressor mechanism unit are connected to each other by a shaft, and a piston attached to an eccentric portion of the shaft revolves with the rotation of the shaft. A main bearing and an auxiliary bearing are mounted on both end faces of a cylinder having the piston provided therein, and the shaft is supported by the main bearing and the auxiliary bearing. In most cases, the diameter of the shaft is constant except for an eccentric portion.

On the other hand, PTL 1(Unexamined Japanese Patent Publication No. 2008-14150) discloses a shaft having different diameters.

PTL 1 discloses a shaft in which the side on which the electric motor unit is provided with respect to the eccentric portion is defined as a main shaft portion, and the side opposite to the side on which the electric motor unit is provided is defined as an auxiliary shaft portion, wherein the diameter of the auxiliary shaft portion is set smaller than the diameter of the main shaft portion.

Note that, in PTL 1, a thrust load of the shaft is received by the lower end of the auxiliary shaft portion, except for the case in which a rolling bearing is provided on the auxiliary bearing.

Meanwhile, in a one-cylinder hermetic compressor that has conventionally been used most often, stress exerted from a compression chamber is received by a main shaft portion disposed on the side of an electric motor unit, so that stress received by an auxiliary shaft portion is extremely small.

Therefore, even if the diameter of the auxiliary shaft portion is set smaller than the diameter of the main shaft portion as disclosed in PTL 1, any problems hardly occur.

However, it has been shown as a result of an analysis conducted by the present inventors that, in a two-cylinder hermetic compressor, stress exerted from each of compression chambers is dispersed into the main shaft portion and the auxiliary shaft portion, so that large stress is also applied on the auxiliary shaft portion.

SUMMARY

The present disclosure provides a two-cylinder hermetic compressor that can reduce maximum stress exerted on an auxiliary shaft portion to suppress an amount of sliding frictional wear on the auxiliary shaft portion.

Specifically, in the two-cylinder hermetic compressor according to one example of the exemplary embodiment in the present disclosure, a diameter of the auxiliary shaft portion is set larger than a diameter of a main shaft portion.

According to this configuration, maximum stress exerted on the auxiliary shaft portion is reduced, whereby an amount of sliding frictional wear on the auxiliary shaft portion can be suppressed.

In addition, in the two-cylinder hermetic compressor according to one example of the exemplary embodiment in the present disclosure, a thrust load of the shaft is received by the surface of an auxiliary bearing on the side of a second cylinder.

According to the configuration in which the thrust load is received by the surface of the auxiliary bearing on the side of the second cylinder, an area of a receiving portion is easy to be designed to be large as compared to the configuration of receiving the thrust load on the auxiliary shaft portion, whereby the thrust load can be stably received.

In addition, in the two-cylinder hermetic compressor according to one example of the exemplary embodiment in the present disclosure, a diameter of a first eccentric portion is set smaller than a dimeter of a second eccentric portion.

According to this configuration, a sliding loss on the first eccentric portion can be decreased.

As described above, according to the present disclosure, maximum stress exerted on an auxiliary shaft portion can be reduced to suppress an amount of sliding frictional wear on the auxiliary shaft portion, in a two-cylinder hermetic compressor.

DETAILED DESCRIPTION

Hereinafter, a description will be given of an exemplary embodiment of the present disclosure with reference to the drawings.

Figure 1:
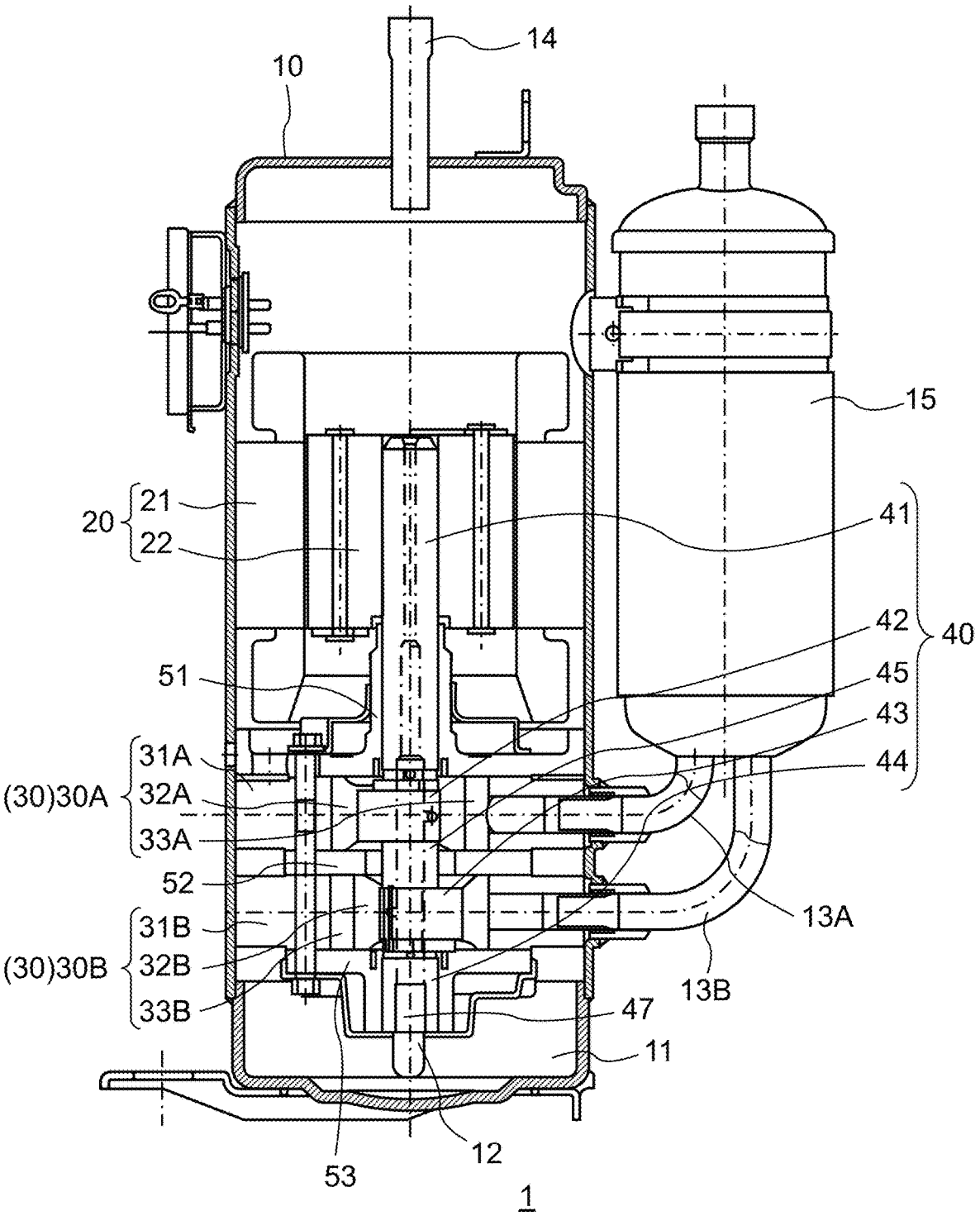
FIG. 1 is a sectional view of a two-cylinder hermetic compressor according to an exemplary embodiment of the present disclosure.

FIG. 1 is a sectional view of a two-cylinder hermetic compressor according to one example of the exemplary embodiment of the present disclosure.

Two-cylinder hermetic compressor 1 according to one example of the present exemplary embodiment in the present disclosure includes electric motor unit 20 and compression mechanism unit 30 in sealed container 10. Electric motor unit 20 and compression mechanism unit 30 are connected to each other by shaft 40.

Electric motor unit 20 includes stator 21 fixed on an inner surface of sealed container 10 and rotor 22 rotating in stator 21.

Two-cylinder hermetic compressor 1 according to the present exemplary embodiment includes first compression mechanism unit 30A and second compression mechanism unit 30B as compression mechanism unit 30.

First compression mechanism unit 30A includes first cylinder 31A, first piston 32A disposed in first cylinder 31A, and a vane (not illustrated) that partitions the interior of first cylinder 31A. First compression mechanism unit 30A suctions a low-pressure refrigerant gas and compresses this refrigerant gas due to the revolution of first piston 32A in first cylinder 31A.

Similar to first compression mechanism unit 30A, second compression mechanism unit 30B includes second cylinder 31B, second piston 32B disposed in second cylinder 31B, and a vane (not illustrated) that partitions the interior of second cylinder 31B. Second compression mechanism unit 30B suctions a low-pressure refrigerant gas and compresses this refrigerant gas due to the revolution of second piston 32B in second cylinder 31B.

Main bearing 51 is disposed on one surface of first cylinder 31A, and intermediate plate 52 is disposed on another surface of first cylinder 31A.

In addition, intermediate plate 52 is disposed on one surface of second cylinder 31B, and auxiliary bearing 53 is disposed on another surface of second cylinder 31B.

That is to say, intermediate plate 52 partitions first cylinder 31A and second cylinder 31B. Intermediate plate 52 has an opening larger than the diameter of shaft 40.

Shaft 40 is constituted by main shaft portion 41 which has rotor 22 attached thereto and is supported by main bearing 51, first eccentric portion 42 having first piston 32A attached thereto, second eccentric portion 43 having second piston 32B attached thereto, and auxiliary shaft portion 44 supported by auxiliary bearing 53.

First eccentric portion 42 and second eccentric portion 43 are formed to have a phase difference of 180 degrees, and connection shaft portion 45 is formed between first eccentric portion 42 and second eccentric portion 43.

First compression chamber 33A is formed between main bearing 51 and intermediate plate 52 and between the inner peripheral surface of first cylinder 31A and the outer peripheral surface of first piston 32A. In addition, second compression chamber 33B is formed between intermediate plate 52 and auxiliary bearing 53 and between the inner peripheral surface of second cylinder 31B and the outer peripheral surface of second piston 32B.

The volume of first compression chamber 33A and the volume of second compression chamber 33B are the same. Specifically, the inner diameter of first cylinder 31A and the inner diameter of second cylinder 31B are the same, and the outer diameter of first piston 32A and the outer diameter of second piston 32B are the same. In addition, the height of first cylinder 31A on the inner periphery thereof and the height of second cylinder 31B on the inner periphery thereof are the same, and the height of first piston 32A and the height of second piston 32B are the same.

Oil reservoir 11 is formed at the bottom of sealed container 10, and oil pickup 12 is provided at the lower end of shaft 40.

In addition, oil feed path 47 is formed inside shaft 40 in the axial direction, and a communication path for feeding oil to a sliding surface of compression mechanism unit 30 is formed in oil feed path 47.

First suction pipe 13A and second suction pipe 13B are connected to the side surface of sealed container 10, and discharge pipe 14 is connected to the top of sealed container 10.

First suction pipe 13A is connected to first compression chamber 33A, and second suction pipe 13B is connected to second compression chamber 33B, respectively. Accumulator 15 is provided at the upstream side of first suction pipe 13A and second suction pipe 13B. Accumulator 15 separates the refrigerant returning from a freezing cycle into a liquid refrigerant and a gas refrigerant. The gas refrigerant flows through first suction pipe 13A and second suction pipe 13B.

Due to the rotation of shaft 40, first piston 32A and second piston 32B revolve in first compression chamber 33A and second compression chamber 33B, respectively.

The gas refrigerant suctioned from first suction pipe 13A and second suction pipe 13B into first compression chamber 33A and second compression chamber 33B is compressed in first compression chamber 33A and second compression chamber 33B due to the revolution of first piston 32A and second piston 32B, and then, discharged into sealed container 10. While the gas refrigerant discharged into sealed container 10 rises through electric motor unit 20, oil is separated therefrom, and then, the resultant gas refrigerant is discharged outside of sealed container 10 from discharge pipe 14.

The oil sucked from oil reservoir 11 due to the rotation of shaft 40 is fed into compression mechanism unit 30 from the communication path to allow the sliding surface of compression mechanism unit 30 to be smooth.

Figure 2:
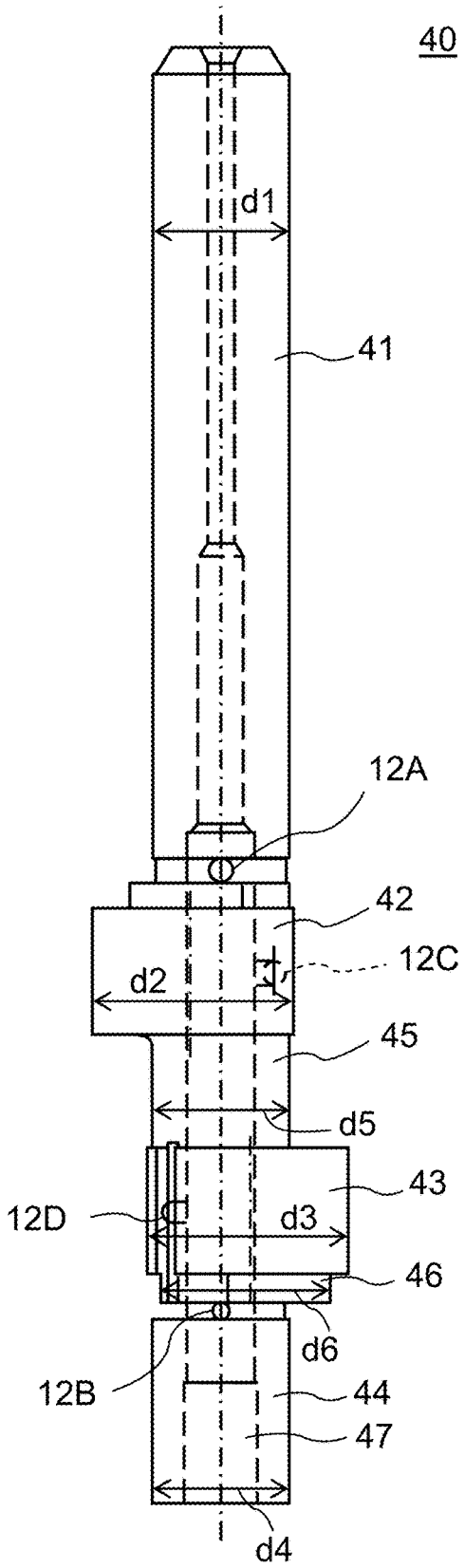
FIG. 2 is a side view of a shaft used in the two-cylinder hermetic compressor according to the exemplary embodiment of the present disclosure.

FIG. 2 is a side view of a shaft used in the two-cylinder hermetic compressor according to one example of the exemplary embodiment of the present disclosure.

Shaft 40 is constituted by main shaft portion 41, first eccentric portion 42, second eccentric portion 43, auxiliary shaft portion 44, and connection shaft portion 45.

If the diameter of main shaft portion 41 is defined as d1, the diameter of first eccentric portion 42 is defined as d2, the diameter of second eccentric portion 43 is defined as d3, the diameter of auxiliary shaft portion 44 is defined as d4, and the diameter of connection shaft portion 45 is defined as d5, diameter d4 of auxiliary shaft portion 44 is set larger than diameter d1 of main shaft portion 41.

Two-cylinder hermetic compressor according to the present exemplary embodiment is configured such that diameter d4 of auxiliary shaft portion 44 is set larger than diameter d1 of main shaft portion 41, thereby being capable of reducing maximum stress exerted on auxiliary shaft portion 44 to suppress an amount of sliding frictional wear on auxiliary shaft portion 44.

Note that, since second piston 32B is inserted into second eccentric portion 43 from auxiliary shaft portion 44, the inner diameter of second piston 32B is required to be set larger as compared to the case in which diameter d4 of auxiliary shaft portion 44 is set to be the same as diameter d1 of main shaft portion 41.

Conventionally, first piston 32A and second piston 32B are generally configured to have the same shape so as to use the same element. However, in the present exemplary embodiment, the inner diameter of second piston 32B is set larger than the inner diameter of first piston 32A. Specifically, by setting the inner diameter of first piston 32A to be smaller than the inner diameter of second piston 32B, diameter d2 of first eccentric portion 42 is made smaller than diameter d3 of second eccentric portion 43. Accordingly, a sliding loss on first eccentric portion 42 can be reduced.

First communication path 12A which is in communication with oil feed path 47 formed inside shaft 40 is open at the end of main shaft portion 41 on the side of first eccentric portion 42, and second communication path 12B which is in communication with oil feed path 47 formed inside shaft 40 is open at the end of auxiliary shaft portion 44 on the side of second eccentric portion 43.

The diameter is set to be smaller than diameter d1 of main shaft portion 41 on the position where first communication path 12A is open, and the diameter is set to be smaller than diameter d4 of auxiliary shaft portion 44 on the position where second communication path 12B is open, whereby oil can be reliably fed to compression mechanism unit 30.

Third communication path 12C which is in communication with oil feed path 47 formed inside shaft 40 is open at the side surface of first eccentric portion 42, and fourth communication path 12D which is in communication with oil feed path 47 formed inside shaft 40 is open at the side surface of second eccentric portion 43.

Thrust receiving portion 46 is provided to second eccentric portion 43 on the side of auxiliary shaft portion 44. Diameter d6 of thrust receiving portion 46 is smaller than diameter d3 of second eccentric portion 43 and larger than diameter d4 of auxiliary shaft portion 44.

The end face of thrust receiving portion 46 is in contact with the surface of auxiliary bearing 53 on the side of second cylinder 31B illustrated in FIG. 1.

The two-cylinder hermetic compressor according to the present exemplary embodiment receives the thrust load of shaft 40 on the surface of auxiliary bearing 53 on the side of second cylinder 31B through the end face of thrust receiving portion 46, thereby being capable of stably receiving the thrust load as compared to the configuration of receiving the thrust load on auxiliary shaft portion 44.

Specifically, in the configuration in which the thrust load of shaft 40 is received by auxiliary shaft portion 44, the thrust load of shaft 40 is received by the area of auxiliary shaft portion 44 excluding the area of oil feed path 47, because oil feed path 47 is formed inside shaft 40. Thrust receiving portion 46 has the diameter larger than the diameter of auxiliary shaft portion 44 and is eccentric relative to auxiliary shaft portion 44. Therefore, according to the configuration in which the thrust load of shaft 40 is received by the end face of thrust receiving portion 46, the area of the receiving portion is easily designed to be large as compared to the configuration in which the thrust load is received by auxiliary shaft portion 44, whereby the thrust load can stably be received.

Figures 3, 4:
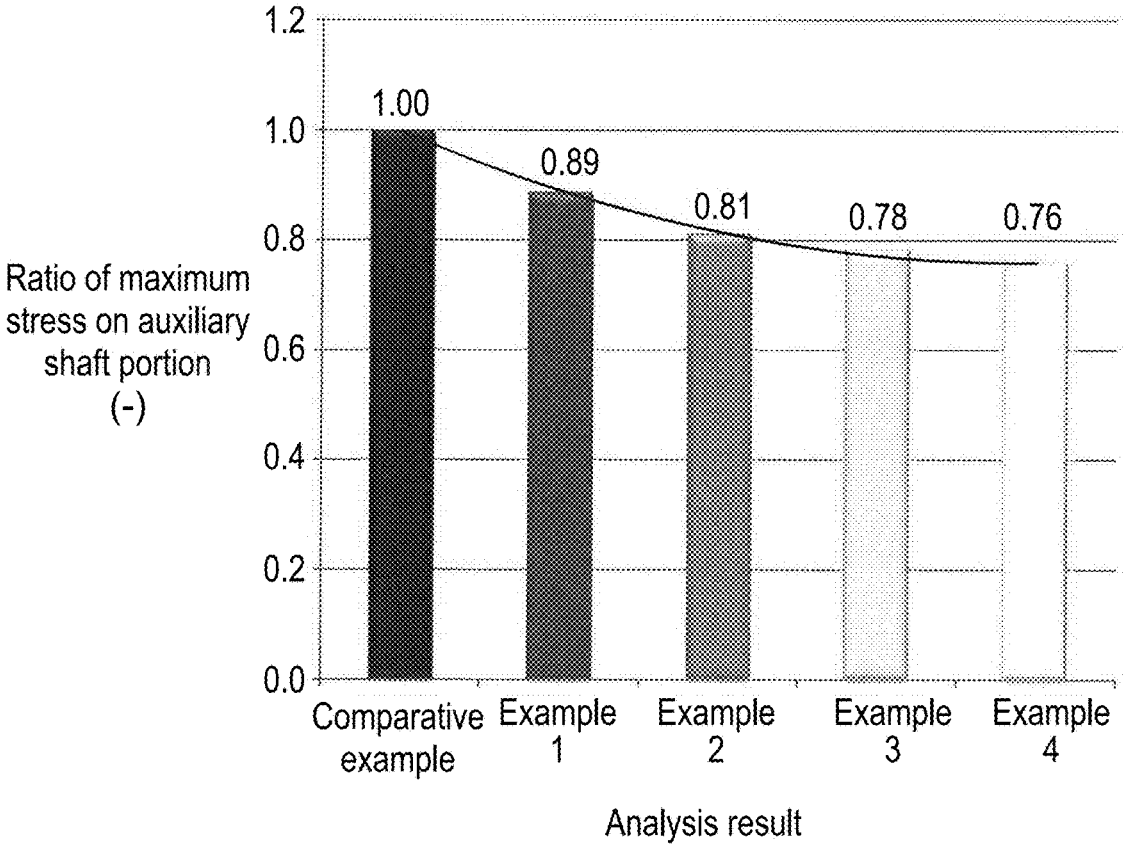
FIG. 3 is a diagram illustrating specifications of Examples and Comparative Example used for the test of maximum stress values on an auxiliary shaft portion in the two-cylinder hermetic compressor according to the exemplary embodiment of the present disclosure.
FIG. 4 is a graph showing the test result of maximum stress values on auxiliary shaft portions in Examples and Comparative Example shown in FIG. 3.
Figure 5:
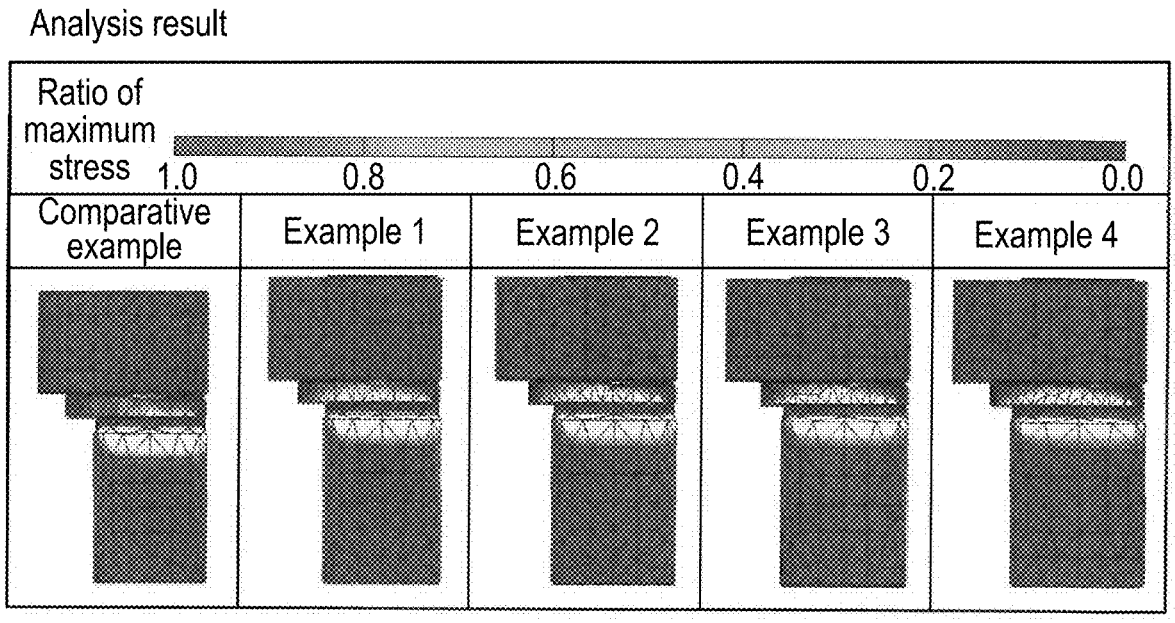
FIG. 5 is an analysis diagram showing a stress distribution on auxiliary shaft portions in Examples and Comparative Example shown in FIG. 3.

FIGS. 3 to 5 illustrate test results of maximum stress values on the auxiliary shaft portion in the two-cylinder hermetic compressor according to the exemplary embodiment of the present disclosure.

FIG. 3 shows specifications of Comparative Example in which diameter d1 of main shaft portion 41 and diameter d4 of auxiliary shaft portion 44 are the same, and Examples 1 to 4 in which diameter d4 of auxiliary shaft portion 44 is set larger than diameter d1 of main shaft portion 41.

Example 1 is configured such that diameter d4 of auxiliary shaft portion 44 is 104% with respect to diameter d1 of main shaft portion 41, Example 2 is configured such that diameter d4 of auxiliary shaft portion 44 is 108% with respect to diameter d1 of main shaft portion 41, Example 3 is configured such that diameter d4 of auxiliary shaft portion 44 is 113% with respect to diameter d1 of main shaft portion 41, and Example 4 is configured such that diameter d4 of auxiliary shaft portion 44 is 117% with respect to diameter d1 of main shaft portion 41.

FIG. 4 is a graph showing the test result of maximum stress values on auxiliary shaft portions 44 in Comparative Example and Examples 1 to 4, and FIG. 5 is an analysis diagram showing a stress distribution on auxiliary shaft portions 44 in Comparative Example and Examples 1 to 4.

As shown in FIG. 4, as compared to Comparative Example in which diameter d1 of main shaft portion 41 is the same as diameter d4 of auxiliary shaft portion 44, the maximum stress value is lower by 11% in Example 1, the maximum stress value is lower by 19% in Example 2, the maximum stress value is lower by 22% in Example 3, and the maximum stress value is lower by 24% in Example 4.

Therefore, the test result shows that remarkable effect is obtained within the range in which the proportion of diameter d4 of auxiliary shaft portion 44 relative to diameter d1 of main shaft portion 41 exceeds 100% and not more than 117%, as compared to Comparative Example. Note that, as apparent from FIG. 4, the proportion is preferably not more than 117%, and more preferably not more than 108%, since the decrease rate of the maximum stress value remains the same level after the proportion exceeds 117%.

While the present disclosure describes a two-cylinder hermetic compressor, it is also applicable to a compressor provided with a plurality of, such as three or more, cylinders.

What is claimed is:

1. A two-cylinder hermetic compressor comprising:

an electric motor unit and a compression mechanism unit in a sealed container, wherein the electric motor unit and the compression mechanism unit are connected to each other by a shaft, the electric motor unit includes a stator fixed on an inner surface of the sealed container and a rotor that rotates in the stator, a first compression mechanism unit and a second compression mechanism unit are provided as the compression mechanism unit, the first compression mechanism unit includes a first cylinder and a first piston provided in the first cylinder, the second compression mechanism unit includes a second cylinder and a second piston provided in the second cylinder, a main bearing is disposed on one surface of the first cylinder and an intermediate plate is disposed on another surface of the first cylinder, the intermediate plate is disposed on one surface of the second cylinder and an auxiliary bearing is disposed on another surface of the second cylinder, the shaft includes a main shaft portion to which the rotor is attached and which is supported by the main bearing, a first eccentric portion to which the first piston is mounted, a second eccentric portion to which the second piston is mounted, and an auxiliary shaft portion supported by the auxiliary bearing, and a diameter of the auxiliary shaft portion supported by the auxiliary bearing is set larger than a diameter of the main shaft portion supported by the main bearing, wherein the shaft further includes a thrust receiving portion on a side of the second eccentric portion facing the auxiliary shaft portion.

2. The two-cylinder hermetic compressor according to claim 1, wherein a surface of the auxiliary bearing is configured to receive a thrust load of the shaft on a side of the second cylinder.

3. The two-cylinder hermetic compressor according to claim 2, wherein a diameter of the first eccentric portion is set smaller than a diameter of the second eccentric portion.

4. The two-cylinder hermetic compressor according to claim 1, wherein a diameter of the first eccentric portion is set smaller than a diameter of the second eccentric portion.

5. The two-cylinder hermetic compressor according to claim 1, wherein a first suction pipe and a second suction pipe are connected to a side surface of the sealed container, the first suction pipe is connected to the first compression mechanism, and the second suction pipe is connected to the second compression mechanism.

6. The two-cylinder hermetic compressor according to claim 1, wherein a diameter of the thrust receiving portion is smaller than a diameter of the second eccentric portion.

7. The two-cylinder hermetic compressor according to claim 6, wherein a diameter of the thrust receiving portion is larger than the diameter of the auxiliary shaft portion.

8. The two-cylinder hermetic compressor according to claim 1, wherein a diameter of the thrust receiving portion is larger than the diameter of the auxiliary shaft portion.

9. The two-cylinder hermetic compressor according to claim 1, wherein an end surface of the thrust receiving portion is in contact with a surface of the auxiliary bearing on a side of the second cylinder.

* * * * *